US005924487A

United States Patent [19]

Oneal et al.

[11] Patent Number: 5,924,487

[45] Date of Patent: Jul. 20, 1999

[54] PROPPANT SLURRY SCREEN APPARATUS AND METHODS OF USING SAME

[75] Inventors: Dean S. Oneal, Lafayette, La.; Colby M. Ross, Carrollton, Tex.

[73] Assignee: Halliburton Energy Services, Inc., Dallas, Tex.

[21] Appl. No.: 08/791,966

[22] Filed: Jan. 31, 1997

[51] Int. Cl.[6] ..... E21B 43/04

[52] U.S. Cl. ..... 166/278; 166/51

[58] Field of Search ..... 166/51, 278, 280

[56] References Cited

U.S. PATENT DOCUMENTS

| | | | |
|---|---|---|---|
| 4,570,714 | 2/1986 | Turner et al. | 166/51 X |
| 4,932,474 | 6/1990 | Schroeder, Jr. et al. | 166/51 X |
| 5,332,038 | 7/1994 | Tapp et al. | 166/51 X |
| 5,443,117 | 8/1995 | Ross | 166/51 |

FOREIGN PATENT DOCUMENTS 0789131 8/1996 European Pat. Off. .

0785337 1/1997 European Pat. Off. .

*Primary Examiner*—David J. Bagnell

*Attorney, Agent, or Firm*—Paul I. Herman; Marlin R. Smith

[57] ABSTRACT

A proppant slurry screen apparatus and associated method of using it prevent sticking of a service tool during proppant slurry delivery to a subterranean wellbore after failure of a crossover portion of the apparatus. In a preferred embodiment, a proppant slurry screen apparatus has a tubular crossover member with an internal flow passage, circulation port, and side wall outlet openings, first and second coaxial tubular structures, the first tubular structure extending above a packer and having a radial port which provides fluid communication between the wellbore above the packer and an annular flow passage between the first and second tubular structures, and a tubular screen positioned between the first and second tubular structures adjacent the port and operative to screen proppant from the proppant slurry.

27 Claims, 5 Drawing Sheets

PROPPANT SLURRY SCREEN APPARATUS AND METHODS OF USING SAME

BACKGROUND OF THE INVENTION

The present invention relates generally to tools used in subterranean wells and, in a preferred embodiment thereof, more particularly provides a proppant slurry screen apparatus for use in formation fracturing operations.

Oftentimes, a potentially productive geological formation beneath the earth's surface contains a sufficient volume of valuable fluids, such as hydrocarbons, but also has a very low permeability. "Permeability" is a term used to describe that quality of a geological formation which enables fluids to move about in the formation. All potentially productive formations have pores, a quality described using the term "porosity", within which the valuable fluids are contained. If, however, the pores are not interconnected, the fluids cannot move about and, thus, cannot be brought to the earth's surface.

When such a formation having very low permeability, but a sufficient quantity of valuable fluids in its pores, is desired to be produced, it becomes necessary to artificially increase the formation's permeability. This is typically accomplished by "fracturing" the formation, a practice which is well known in the art and for which purpose many methods have been conceived. Basically, fracturing is achieved by applying sufficient pressure to the formation to cause the formation to crack or fracture, hence the name. The desired result being that the cracks interconnect the formation's pores and allow the valuable fluids to be brought out of the formation and to the surface.

A conventional method of fracturing a formation begins with drilling a subterranean well into the formation and cementing a protective tubular casing within the well. The casing is then perforated to provide fluid communication between the formation and the interior of the casing which extends to the surface. A packer is set in the casing to isolate the formation from the rest of the wellbore, and hydraulic pressure is applied to the formation via tubing which extends from the packer to pumps on the surface.

The pumps apply the hydraulic pressure by pumping fracturing fluid down the tubing, through the packer, into the wellbore below the packer, through the perforations, and finally, into the formation. The pressure is increased until the desired quality and quantity of cracks is achieved. Much research has gone into discerning the precise amount and rate of fracturing fluid and hydraulic pressure to apply to the formation to achieve the desired quality and quantity of cracks.

The fracturing fluid's composition is far from a simple matter itself. Modern fracturing fluids may include sophisticated man-made proppants suspended in gels. "Proppant" is the term used to describe material in the fracturing fluid which enters the formation cracks once formed and while the hydraulic pressure is still being applied (that is, while the cracks are still being held open by the hydraulic pressure), and acts to prop the cracks open. When the hydraulic pressure is removed, the proppant keeps the cracks from closing completely. The proppant thus helps to maintain the artificial permeability of the formation after the fracturing job is over. Fracturing fluid containing suspended proppant is also called a slurry.

A proppant may be nothing more than a very fine sand, or it may be a particulate material specifically engineered for the job of holding formation cracks open. Whatever its composition, the proppant must be very hard and strong to withstand the forces trying to close the formation cracks. These qualities also make the proppant a very good abrasive. It is not uncommon for holes to be formed in the protective casing, tubing, pumps, and any other equipment through which a slurry is pumped.

Particularly susceptible to abrasion wear from pumped slurry is any piece of equipment in which the slurry must make a sudden or significant change in direction. The slurry, being governed by the laws of physics, including the principles of inertia, tends to maintain its velocity and direction of flow, and resists any change thereof. An object in the flowpath of the slurry which tends to change the velocity or direction of the slurry's flow will soon be worn away as the proppant in the slurry incessantly impinges upon the object.

Of particular concern in this regard is the piece of equipment attached to the tubing extending below the packer which takes the slurry as it is pumped down the tubing and redirects it radially outward so that it exits the tubing and enters the formation through the perforations. That piece of equipment is known to those skilled in the art as a crossover. Assuming, for purposes of convenience, that the tubing extends vertically through the wellbore, and that the formation is generally horizontal, the crossover must change the direction of the slurry by ninety degrees. Because of this significant change of direction, few pieces of equipment (with the notable exception of the pumps) must withstand as much potential abrasive wear as the crossover.

In addition, the crossover is frequently called upon to do several other tasks while the slurry is being pumped through it. For example, the crossover typically contains longitudinal circulation ports through which fracturing fluids that are not received into the formation after exiting the crossover are transmitted back to the surface through an annular area between the tubing and the wellbore casing above the packer.

Space limitations in the wellbore dictate that the circulation ports are not far removed from the flowpath of the slurry through the crossover. If the crossover is worn away such that the slurry flowpath achieves fluid communication with the circulation ports in the crossover, the fracturing job must cease while the tubing is removed from the wellbore to replace the crossover at great loss of time and money. Otherwise, the slurry may enter the circulation ports in the crossover, flow into the annular area between the tubing and the wellbore casing above the packer or a screen annulus area below the packer, and possibly stick the tool in the well.

A major reason for the service tool sticking when the crossover becomes eroded between the slurry flowpath and the circulation ports is that, unless the pumps are stopped immediately after the slurry flowpath achieves fluid communication with the circulation ports, the slurry will be pumped through the circulation ports to the annular area above the packer. This results in the proppant in the slurry settling out in the annular area above the packer and around the tubing from which the service tool is suspended. It is not uncommon for such pumping of the slurry into the annular area above the packer to go unnoticed and, consequently, large volumes of proppant to be deposited around the tubing.

For the above reasons and others, the crossover has commonly been considered a critical piece of equipment, whose failure during slurry delivery usually means failure of the entire fracturing job. Extensive measures have been employed in the past to avoid failure of the crossover, that is, to retard abrasive wear of the crossover and the resultant communication between the slurry flowpath and circulation ports. None, however, have solved the problem of how to prevent sticking of the service tool after the crossover has failed by preventing the deposition of proppant in the annular area above the packer.

From the foregoing, it can be seen that it would be quite desirable to provide a proppant slurry screen apparatus which prevents depositing of proppant around the tubing above or below the packer following the failure of the crossover. It is accordingly an object of the present invention to provide such a proppant slurry screen apparatus and associated methods of using same.

SUMMARY OF THE INVENTION

In carrying out the principles of the present invention, in accordance with a preferred embodiment thereof, a proppant slurry screen apparatus and method of using same are provided, which apparatus and method are specially adapted for utilization in formation fracturing operations in subterranean wellbores. The apparatus prevents proppant from entering the annular area above the packer if a crossover portion of the apparatus fails by erosion due to the abrasive slurry being forced through it.

In broad terms, a proppant slurry screen apparatus which is operatively positionable in a subterranean wellbore wherein a packer is set, the packer having an axial internal bore extending from a first to a second side of the packer, the bore receiving the apparatus thereinto from the first side of the packer, is provided, the apparatus including a tubular outer housing having an axial portion and inner and outer side surfaces, the outer housing extending from the packer first side to the packer second side, the outer housing outer side surface slidably engaging the packer bore, and the axial portion extending axially outward from the packer first side, the axial portion having a radially extending port formed therethrough, a tubular inner mandrel axially disposed within the outer housing, the inner mandrel having inner and outer side surfaces, the inner mandrel inner side surface defining an axial flow passage therein, and the inner mandrel outer side surface and the outer housing inner side surface defining a circulation flow passage therebetween, the circulation flow passage being in fluid communication with the outer housing port, and a screen disposed adjacent the outer housing port, the screen being capable of filtering fluid flowing from the circulation flow passage to the wellbore on the packer first side.

A proppant slurry screen apparatus operatively positionable in a subterranean wellbore during flow thereinto of a slurry, the slurry including a fluid portion and a plurality of particles, is also provided, the apparatus including a first tubular structure having first and second opposite ends, an exterior surface, and a first flow passage through which the slurry may be axially flowed from the first tubular structure first opposite end to the first tubular structure second opposite end, the first tubular structure being axially disposed within the wellbore, and a second tubular structure having first and second opposite ends, interior and exterior surfaces, an opening formed axially intermediate the second tubular structure first and second opposite ends and extending from the second tubular structure interior surface to the second tubular structure exterior surface, the opening having at least one dimension which permits fluid portion flow therethrough but prevents the particles from flowing therethrough, and the second tubular structure axially and exteriorly overlying the first tubular structure such that a second flow passage is formed radially intermediate the first tubular structure exterior surface and the second tubular structure interior surface.

Yet another proppant slurry screen apparatus is provided, the apparatus being operatively positionable in a subterranean wellbore during flow thereinto of a slurry, the slurry including a fluid portion and a plurality of abrasive particles. The apparatus includes a first tubular structure having first and second opposite ends, an exterior surface, and a first flow passage through which the slurry may be axially flowed from the first tubular structure first opposite end to the first tubular structure second opposite end, the first tubular structure being axially disposed within the wellbore, a second tubular structure having first and second opposite ends, interior and exterior surfaces, an opening formed axially intermediate the second tubular structure first and second opposite ends and extending from the second tubular structure interior surface to the second tubular structure exterior surface, and first and second seal surfaces, the first and second seal surfaces being formed on the second tubular structure interior surface such that the opening is axially intermediate the first and second seal surfaces, the second tubular structure axially and exteriorly overlying the first tubular structure such that a second flow passage is formed radially intermediate the first tubular structure exterior surface and the second tubular structure interior surface, a filter structure having first and second opposite end portions, and interior and exterior surfaces, the filter structure being capable of filtering the abrasive particles from the fluid portion in the second flow passage, the filter structure first and second opposite end portions having first and second seal surfaces formed respectively thereon, and first and second seal structures, the first seal structure sealingly engaging the first tubular structure first seal surface and the filter structure first seal surface, and the second seal structure sealingly engaging the first tubular structure second seal surface and the filter structure second seal surface.

For use in a subterranean wellbore wherein a packer is set, the packer having an axial internal bore extending from a first to a second side of the packer, in conjunction with an abrasive slurry delivery structure having a crossover structure disposed in the wellbore on the second side of the packer with an internal flow passage through which an abrasive slurry containing abrasive particles may be axially flowed, a side wall outlet opening bounded by a peripheral side wall edge portion and outwardly through which abrasive slurry material from the internal flow passage may be discharged, and an internal circulation passage formed adjacent the peripheral side wall edge portion, a method of filtering abrasive particles in the internal circulation passage after slurry erosion of the peripheral side wall edge portion is provided, the method including the steps of providing a tubular outer housing having an axial portion and inner and outer side surfaces, the axial portion having a radially extending port formed therethrough, inserting the outer housing into the packer such that the outer housing extends from the packer first side to the packer second side and the outer housing axial portion extends axially outward from the packer first side, providing a tubular inner mandrel having inner and outer side surfaces, the inner side surface defining an axial flow passage therein, the inner mandrel axial flow passage being in fluid communication with the crossover structure internal flow passage, disposing the inner mandrel axially within the outer housing such that the inner mandrel outer side surface and the outer housing inner side surface define a circulation flow passage therebetween and the circulation flow passage is in fluid communication with the outer housing port and the crossover structure internal circulation passage, providing a screen capable of filtering the abrasive particles from the abrasive slurry, and disposing the screen such that fluid flowing from the circulation flow passage to the outer housing port must pass through the screen.

A method of screening proppant delivered to a subterranean wellbore in a pressurized slurry is also provided, the method including the steps of providing a first tubular structure having first and second opposite ends, an exterior surface, and a first flow passage through which the slurry may be axially flowed from the first tubular structure first opposite end to the first tubular structure second opposite end, disposing the first tubular structure axially within the wellbore, providing a second tubular structure having first and second opposite ends, interior and exterior surfaces, an opening formed axially intermediate the second tubular structure first and second opposite ends and extending from the second tubular structure interior surface to the second tubular structure exterior surface, forming first and second seal surfaces on the second tubular structure interior surface such that the opening is axially intermediate the first and second seal surfaces, disposing the second tubular structure axially and exteriorly overlying the first tubular structure, forming a second flow passage radially intermediate the first tubular structure exterior surface and the second tubular structure interior surface, providing a filter structure having first and second opposite end portions, and interior and exterior surfaces, the filter structure being capable of filtering the abrasive particles from the fluid portion in the second flow passage, forming first and second seal surfaces on the filter structure first and second opposite end portions, respectively, providing first and second seal structures, sealingly engaging the first tubular structure first seal surface and the filter structure first seal surface with the first seal structure, and sealingly engaging the first tubular structure second seal surface and the filter structure second seal surface with the second seal structure.

A method of screening abrasive particles in a subterranean wellbore during pressurized particle slurry delivery into the wellbore is also provided, the method including the steps of providing a first tubular structure having first and second opposite ends, an exterior surface, and a first flow passage through which the slurry may be axially flowed from the first tubular structure first opposite end to the first tubular structure second opposite end, disposing the first tubular structure axially within the wellbore, providing a second tubular structure having first and second opposite ends, and interior and exterior surfaces, forming an opening axially intermediate the second tubular structure first and second opposite ends and extending from the second tubular structure interior surface to the second tubular structure exterior surface, the opening having at least one dimension which permits slurry flow therethrough but prevents the particles from flowing therethrough, disposing the second tubular structure axially and exteriorly overlying the first tubular structure, and forming a second flow passage radially intermediate the first tubular structure exterior surface and the second tubular structure interior surface.

The disclosed proppant slurry screen apparatus and method of using same permit fracturing operations to be performed more economically and with less risk of sticking the service tool in the wellbore.

DETAILED DESCRIPTION

Figure 1:
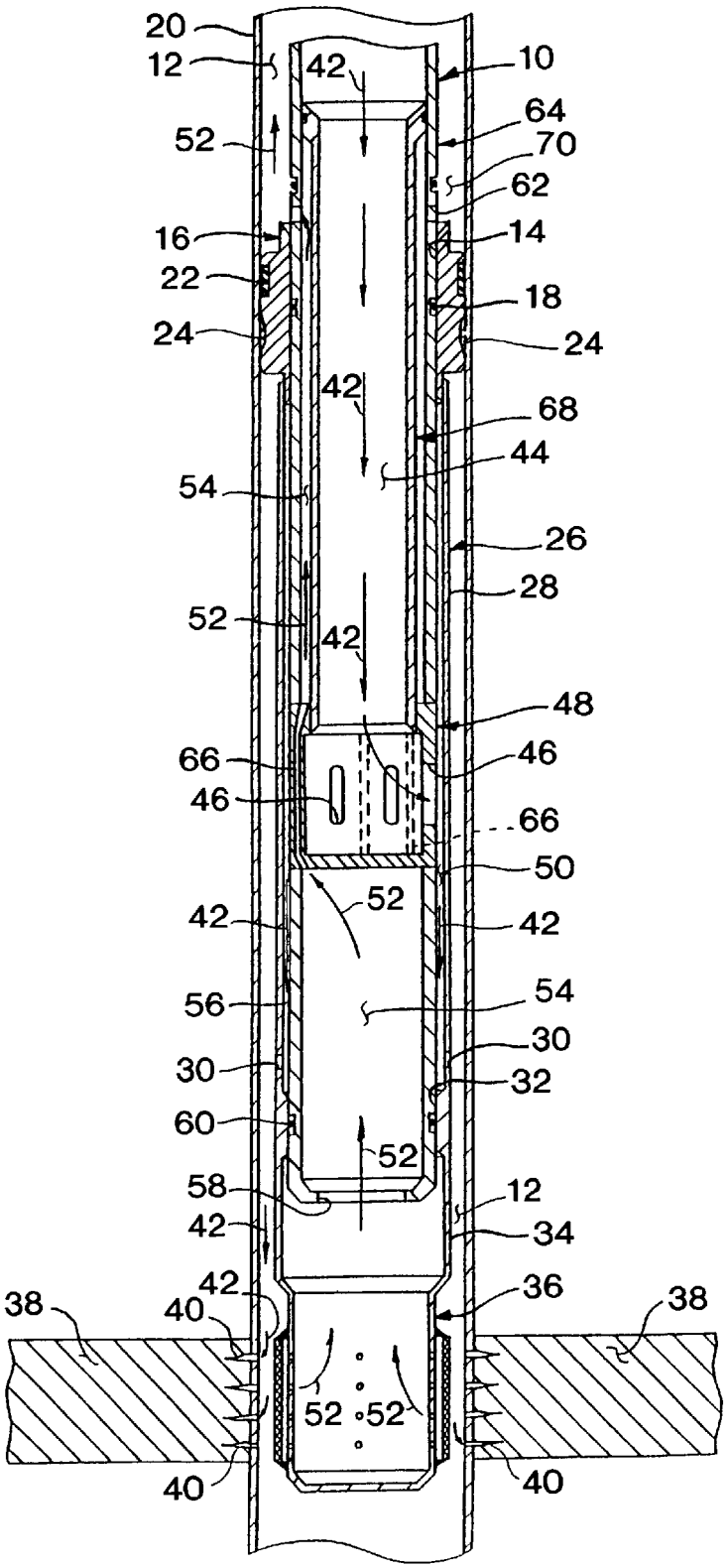
FIG. 1 PRIOR ART
FIG. 1 (Prior Art) is a cross-sectional view of a prior art service tool operatively positioned within a packer in a subterranean wellbore.

FIG. 1 (Prior Art) shows a conventional service tool 10 operatively positioned in a subterranean wellbore 12 to perform a fracturing and/or gravel packing operation. The following detailed description is given with the assumption that the wellbore 12 is substantially vertical as representatively illustrated in FIG. 1 (Prior Art), with terms such as "upward" and "downward" referring to such orientation. It is to be understood that the service tool 10 may be utilized in otherwise oriented wellbores.

Service tool 10 is inserted partially through the internal bore 14 of a packer 16, circumferential seal 18 on the service tool sealingly contacting the bore. The packer 16 has been set in protective casing 20 so that packer rubber 22 forms a pressure seal between the packer 16 and the casing 20, and packer slips 24 bite into and grip the casing, preventing movement of the packer relative to the casing.

Attached to and suspended from the packer 16 is an outer tubular member 26, in which the service tool 10 is received. Outer tubular member 26 includes a longitudinally (i.e., axially) extending upper portion 28, circumferentially spaced ports 30, an inner seal surface 32, and a lower portion 34.

A sand screen 36 is attached to the outer tubular member lower portion 34 in the wellbore 12 opposite a potentially productive formation 38 which has previously had perforations 40 formed in it. Perforations 40 extend from the wellbore 12 into the formation 38 and provide fluid communication therebetween.

In a typical formation fracturing operation, a proppant slurry 42 is pumped from the earth's surface through tubing (not shown) and into an internal axial flow passage 44 of the service tool 10. The slurry 42 radially exits the service tool 10 through circumferentially spaced exit ports 46 formed on a crossover portion 48 of the service tool 10. Upon exiting the service tool 10, the slurry 42 enters an annular flow passage 50 formed between the service tool 10 and the outer tubular member upper portion 28.

The slurry 42 flows through the annular flow passage 50 and then radially exits the outer tubular member 26 through the ports 30. After exiting the ports 30, the slurry 42 enters the wellbore 12 between the outer tubular member 26 and the casing 20 below the packer 16. Pressure is then increased on the slurry 42 at the earth's surface to force the slurry 42 into the formation 38 through perforations 40.

Not all of the slurry 42 is received into the formation 38, however. A fluid portion 52 of the slurry 42 (i.e., a portion of the slurry minus the proppant) is circulated back to the pumps on the earth's surface. Prior to being circulated back to the pumps, the fluid portion 52 enters the sand screen 36 which removes the proppant from the slurry 42.

The fluid portion 52 then flows through opening 58 and into an internal flow passage 54 formed in a lower portion 56 of the service tool 10. Lower portion 56 is sealingly inserted into the outer tubular member 26. Circumferential seals 60 (only one of which is shown in FIG. 1) provide a fluid seal between the lower portion 56 and the seal surface 32 of the outer tubular member 26.

Flow passage 54 extends through the crossover 48 by means of longitudinally extending and circumferentially spaced apart circulation ports 66. The circulation ports 66 are typically located in the crossover 48 in close proximity to the exit ports 46. Fluid portion 52 flows in flow passage 54 longitudinally upward through the service tool 10 until it exits through ports 62 formed radially through an outer housing 64. Thus, between the outer housing 64 and an inner mandrel 68, the flow passage 54 extends from the crossover 48 circulation ports 66 to the ports 62 in the outer housing 64.

When the fluid portion 52 exits ports 62 and enters the wellbore 12 above the packer 16, it flows in an annular area 70. Annular area 70 is defined as extending radially between the outer housing 64 (and the tubing from which the service tool 10 is suspended) and the casing 20, and longitudinally between the packer 16 and a wellhead (not shown) at the earth's surface. If there is any proppant or debris in the fluid portion 52, it will typically settle out of the fluid portion and come to rest on top of the packer 16 before the fluid portion reaches the wellhead, since it is usually several thousand feet from the ports 62 to the wellhead.

It will be readily apparent to one skilled in the art that proppant and other debris settling out in the annular area 70 above the packer 16 and between the service tool 10 and the casing 20 poses a significant danger of sticking the service tool 10. Even when the wellbore 12 is not substantially vertical as shown in FIG. 1 (Prior Art), an accumulation of proppant and/or debris between the service tool 10 and the casing 20 may cause the service tool 10 to become stuck in the wellbore 12.

The danger of sticking is substantially increased when a very large amount of proppant is pumped into the annular area 70. Such a situation occurs when exit ports 46 are eroded by the proppant slurry 42 to the point that axial flow passage 44 is in fluid communication with flow passage 54 and the slurry 42 is permitted to enter the circulation ports 66 in the crossover 48. When this happens, the slurry 42 may be pumped through the circulation ports 66, into the flow passage 54, and then into the annular area 70 above the packer 16.

Figure 2A:
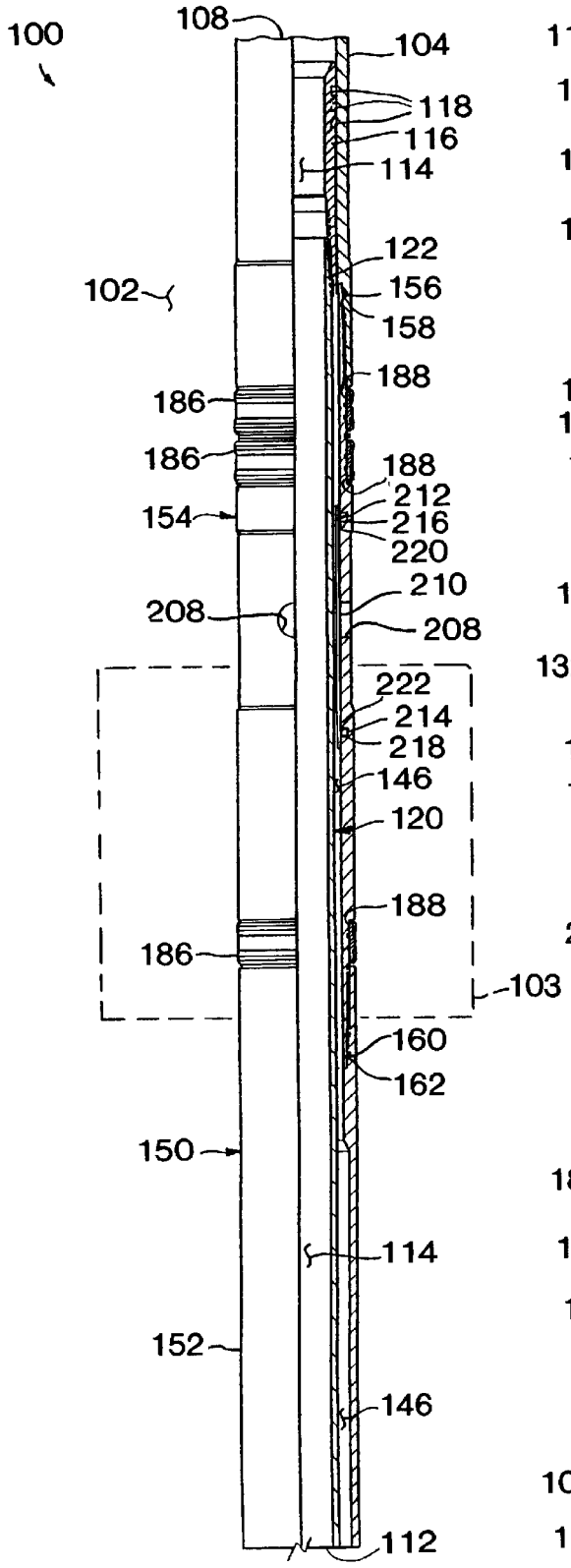
FIGS. 2A–2B are quarter-sectional views of a proppant slurry screen apparatus embodying principles of the present invention.
Figure 2B:
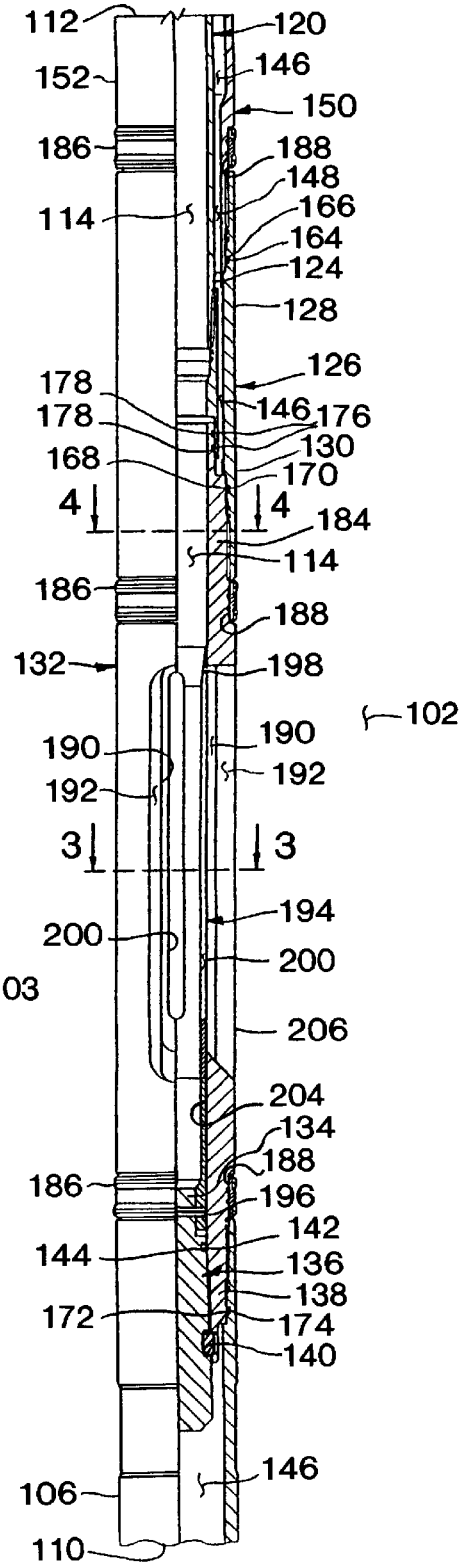

Turning now to FIGS. 2A and 2B, a proppant slurry screen apparatus 100 which embodies principles of the present invention is shown. In the following detailed description of the apparatus 100 representatively illustrated in FIGS. 2A and 2B, and subsequent figures described hereinbelow, directional terms such as "upper", "lower", "upward", "downward", etc. will be used in relation to the apparatus 100 as it is depicted in the accompanying figures. It is to be understood that the apparatus 100 may be utilized in vertical, horizontal, inverted, or inclined orientations without deviating from the principles of the present invention.

Apparatus 100, as representatively illustrated in FIGS. 2A and 2B, is specially adapted for use within a service tool string (not shown), which is suspended from tubing extending to the earth's surface, the tubing being longitudinally disposed within protective casing in a subterranean wellbore 102. In FIGS. 2A and 2B, the wellbore 102 is external to the apparatus 100. The service tool string is typically inserted through a packer 103 (shown in phantom) during a fracturing job. A pressurized, abrasive slurry is then pumped through the tubing and into the service tool string. Tubular upper connector 104 and lower connector 106 permit interconnection of the apparatus 100 into the service tool string. Accordingly, upper portion 108 of upper connector 104 is connected to the service tool string above the apparatus 100, and lower portion 110 of lower connector 106 is connected to the remainder of the service tool string extending below the apparatus 100. Note that illustratively cut surface 112 of FIG. 2A is continuous with the same cut surface 112 of FIG. 2B.

Axial flow passage 114 extends longitudinally (i.e., axially) downward from the upper portion 108 of upper connector 104, through the upper connector, and into a generally tubular seal sub 116. Seal sub 116 has three longitudinally spaced apart circumferential seals 118 disposed thereon which sealingly engage the upper connector 104. From the seal sub 116, the axial flow passage 114 extends axially downward through a tubular inner mandrel 120. Inner mandrel 120 is sealingly and threadedly attached to the seal sub 116 at an upper end 122 of the inner mandrel.

At a lower end 124 of the inner mandrel 120, the inner mandrel is sealingly and threadedly attached to an upper portion 128 of a generally tubular connector 126. The axial flow passage 114 extends axially through the tubular connector 126 and into a crossover 132 which is sealingly and threadedly attached to a lower portion 130 of the tubular connector. The axial flow passage 114 terminates at upper radially reduced portion 134 of generally cylindrical plug 136.

Plug 136 is threadedly installed into lower portion 138 of crossover 132 and secured with a pair of set screws 140 (only one of which is visible in FIG. 2B). Sealing engagement between the plug 136 and the lower portion 138 of crossover 132 is provided by seal 142 disposed in circumferential groove 144 externally formed on the plug.

Radially displaced, longitudinally extending, circulation flow passage 146 extends downwardly through tubular connector 126, longitudinally through the crossover 132 in a manner that will be described more fully hereinbelow, through the lower connector 106, and to lower portion 110. Upwardly from the tubular connector 126, the circulation flow passage 146 extends longitudinally through an annulus 148 formed between the inner mandrel 120 and an outer housing 150.

Outer housing 150 includes a tubular extension sub 152 and a tubular ported housing 154 which are threadedly and sealingly joined together in a radially outwardly overlying relationship to the inner mandrel 120. Outer housing 150 may include more than one extension sub 152 as needed to selectively position the crossover 132 with respect to the ported housing 154, in which case a correspondingly extended inner mandrel 120 is also utilized.

When the apparatus 100 is operatively installed in the wellbore 102, the circulation flow passage 146 in the apparatus 100 is sealingly isolated from the wellbore 102 external to the apparatus by seal 156 disposed in circumferential groove 158 internally formed on the upper connector 104, seal 160 disposed in circumferential groove 162 internally formed on extension sub 152, seal 164 disposed in circumferential groove 166 internally formed on tubular connector 126, seal 168 disposed in circumferential groove 170 internally formed on the tubular connector 126, and by seal 172 disposed in circumferential groove 174 internally formed on the lower connector 106.

The circulation flow passage 146 is sealingly isolated from axial flow passage 114 in the apparatus 100 by seal 142, seals 118, and a pair of seals 176, each disposed in one of a pair of circumferential grooves 178 externally formed on an upper portion 184 of the crossover 132 which is threadedly installed coaxially into the tubular connector 126.

In operation, the proppant slurry is pumped downwardly through the longitudinal flow passage 114, radially outward through the crossover 132 and into the wellbore 102, and outwardly into the geological formation being fractured and/or gravel packed (not shown). The fluid portion of the proppant slurry (minus the proppant) which is not retained in the formation is returned to the earth's surface through the circulation flow passage 146.

Annular seal rings 186 are disposed in longitudinally spaced apart external annular recesses 188 formed between upper connector 104 and ported housing 154, between ported housing 154 and extension sub 152, between extension sub 152 and tubular connector 126, between tubular connector 126 and upper portion 184 of crossover 132, and between lower portion 138 of crossover 132 and lower connector 106. The seal rings 186 seal the apparatus 100 within the packer 103 and other equipment into which the apparatus 100 may be inserted.

Four longitudinally extending circumferentially spaced apart slotted outlet openings or exit ports 190 (three of which are visible in FIG. 2B), having external radially extending and circumferentially sloping surfaces 192 formed thereon, provide fluid communication between the axial flow passage 114 and the wellbore 102. It is through these exit ports 190 that the proppant slurry must pass in its transition from longitudinal flow in the axial flow passage 114 to radial flow into the wellbore 102. Because of the substantial change of direction from longitudinal flow to radial flow of the slurry through the exit ports 190, the exit ports are particularly susceptible to abrasion wear from proppant contained in the slurry.

In order to protect the exit ports 190 against abrasion wear, a tubular protective sleeve 194 is coaxially disposed within the crossover 132. The protective sleeve 194 is made of a suitably hard and tough abrasion resistant material, such as tungsten carbide, or is made of a material, such as alloy steel, which has been hardened. If made of an alloy steel, the protective sleeve 194 is preferably through-hardened by a process such as nitriding. The protective sleeve 194 is secured into the crossover 132 by drive pin 196 which extends laterally through the protective sleeve and the upper portion 134 of the plug 136.

Upper portion 198 of protective sleeve 194 extends axially upward past the exit ports 190 in the crossover 132, thereby completely internally overlapping the portion of the crossover 132 in which the exit ports 190 are located. Four circumferentially spaced and longitudinally extending slotted ports 200 are formed radially through the sleeve 194 and are aligned with the exit ports 190 in the crossover 132. The ports 200 in the sleeve 194, however, are smaller in length and width than the ports 190 in the crossover 132, such that the sleeve 194 completely internally overlaps the crossover 132 in the exit ports 190 area of the crossover.

Figure 3:
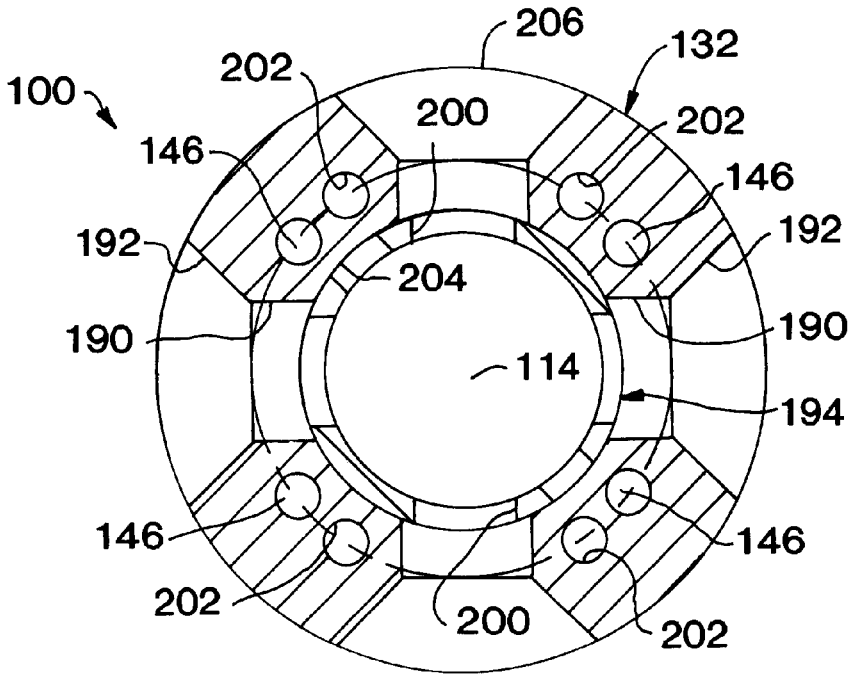
FIG. 3 is an enlarged scale cross-sectional view of a crossover portion of the proppant slurry screen apparatus, taken along line 3—3 of FIG. 2B.

Referring additionally now to FIG. 3, a cross-sectional view may be seen of the apparatus 100 representatively illustrated in FIGS. 2A–2B. The cross-section is taken along line 3—3 of FIG. 2B which extends laterally through the crossover 132. In this view, the manner in which circulation flow passage 146 extends longitudinally through the crossover 132 may be seen.

Eight longitudinally extending and circumferentially spaced circulation ports 202 are disposed radially intermediate inner diameter 204 of the crossover 132 and outer diameter 206 of the crossover. Two each of the circulation ports 202 are disposed in the crossover 132 circumferentially intermediate each pair of exit ports 190. Flow ports 200 in protective sleeve 194, being somewhat smaller in width than the exit ports 190, act to protect the exit ports 190 from abrasion wear due to radially outwardly directed flow of the slurry. It may be clearly seen in FIG. 3 that if exit ports 190 wear appreciably circumferentially outward, or if the protective sleeve 194 and inner diameter 204 of the crossover 132 wear appreciably radially outward, the exit ports 190 and flow passage 114 will eventually be in fluid communication with the circulation ports 202. If such abrasive wear of the crossover 132 does occur, the proppant slurry will be permitted to enter the circulation ports 202.

Figure 4:
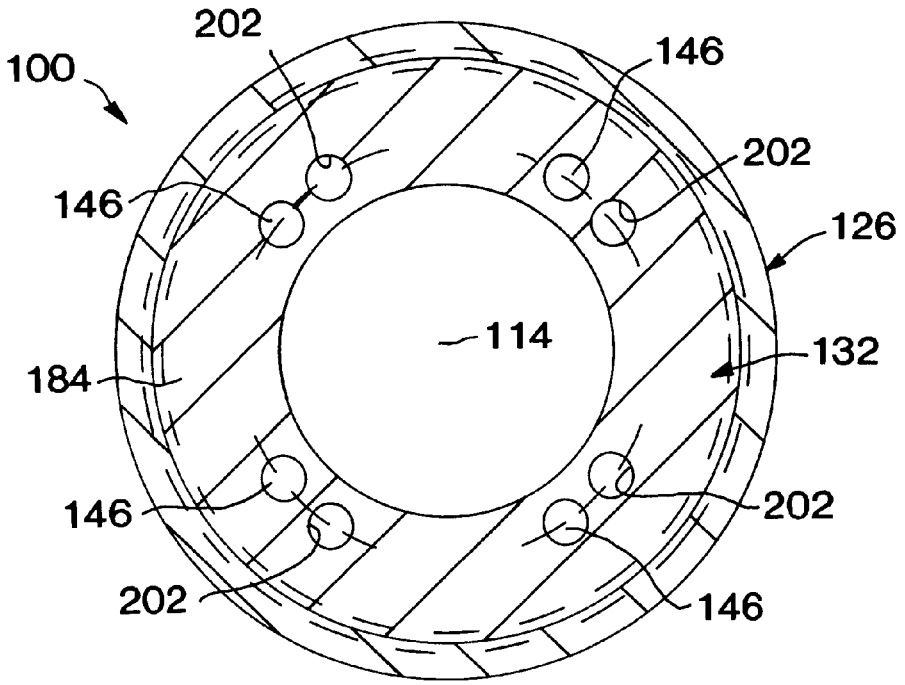
FIG. 4 is an enlarged scale cross-sectional view of the proppant slurry screen apparatus, taken along line 4—4 of FIG. 2B.

Referring additionally now to FIG. 4, a cross-sectional view of the apparatus 100, taken laterally along line 4—4 of FIG. 2B may be seen. FIG. 4 further illustrates the manner in which the circulation ports 202 extend longitudinally through the crossover 132. It may thus be clearly seen that circulation ports 202 provide fluid communication for the circulation flow passage 146 from the tubular connector 126 attached to upper portion 184 of the crossover 132 to the lower connector 106 attached to lower portion 138 of the crossover 132. Consequently, if the proppant slurry enters the circulation ports 202 adjacent the crossover exit ports 190 as above described, the proppant slurry will be permitted to enter the circulation flow passage 146 in the annulus 148 between the outer housing 150 and inner mandrel 120.

If the proppant slurry enters the circulation flow passage 146 in the annulus 148 and is permitted to flow out into the wellbore 102 through circumferentially spaced apart and radially extending ports 208 formed on ported housing 154 and disposed above the packer 103, the apparatus 100 will be in danger of becoming stuck. To prevent the apparatus 100 from becoming stuck, even though the proppant slurry has broken through to the circulation flow passage 146 in the crossover 132, apparatus 100 includes specially designed features which prevent passage of the proppant into the wellbore 102 through the ports 208.

Referring specifically now to FIGS. 2A and 2B, a tubular screen 210 is disposed within the ported housing 154, radially inward from the ports 208. The screen 210 inwardly overlaps the ports 208. Screen 210 is also disposed in the circulation flow passage 146 between the inner mandrel 120 and the outer housing 150, but is somewhat radially spaced apart from the inner mandrel 120 so that the circulation flow passage 146 extends axially through the screen 210.

Screen 210 may be made of any suitable material capable of filtering proppant and debris from the fluid portion. Suitable materials for the screen 210 include sintered metal and wire-wrapped sand screen. The preferred material for the screen 210 representatively illustrated in FIG. 2A is sintered metal, but it is to be understood that other materials may be utilized without departing from the principles of the present invention.

Seals 212 and 214 are disposed in circumferential grooves 216 and 218, respectively, internally formed on the ported housing 154, straddling the ports 208. Seals 212 and 214 sealingly engage upper and lower portions 220 and 222, respectively, of the screen 210. Thus, any fluid flowing from the circulation flow passage 146 and through the ports 208 to the wellbore 102 must first pass through the screen 210. In this manner, the screen 210 prevents any proppant or debris in the fluid portion from entering the wellbore 102 above the packer 103.

Thus has been described the proppant slurry screen apparatus 100 which prevents the service tool from becoming stuck in the wellbore 102 after the crossover 132 has been abraded such that the proppant slurry enters the circulation flow ports 202. Use of the above described apparatus 100 prevents proppant from settling out in the wellbore 102 above the packer 103 and between the service tool and the casing.

Figure 5:
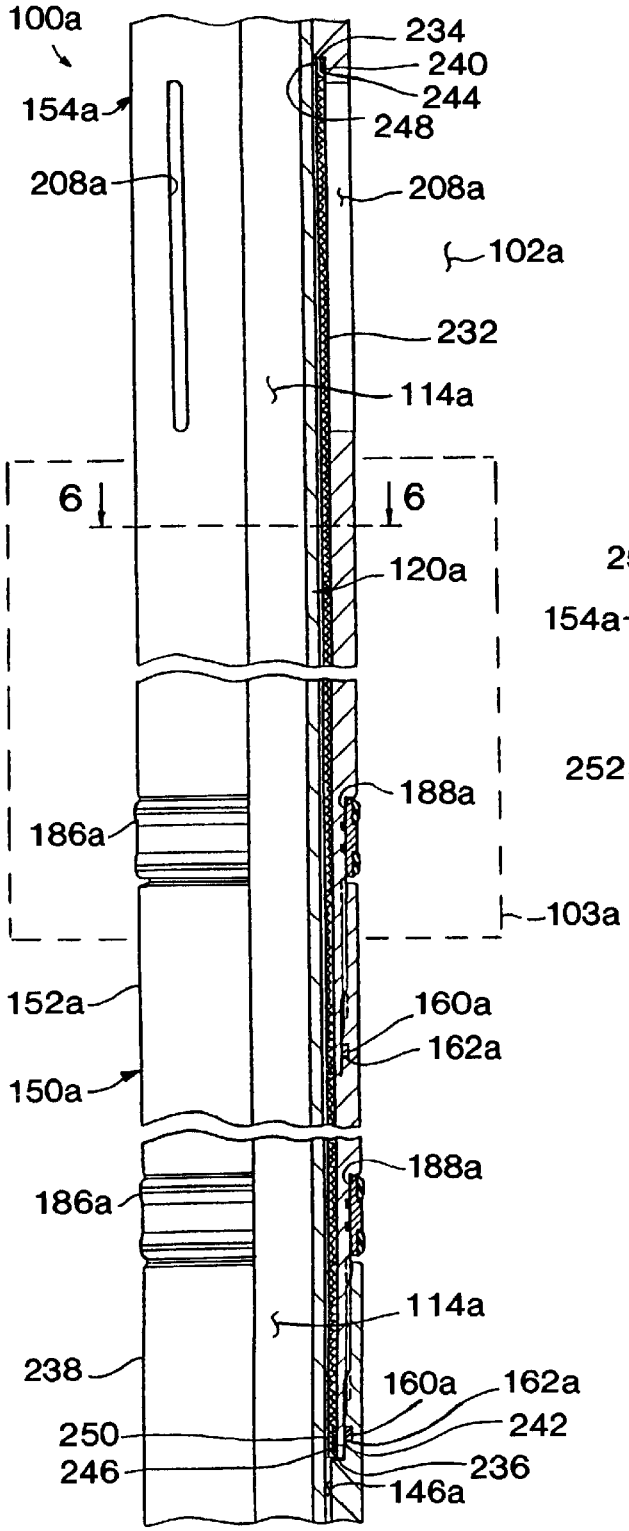
FIG. 5 is a quarter-sectional view of a second proppant slurry screen apparatus embodying principles of the present invention.
Figure 6:
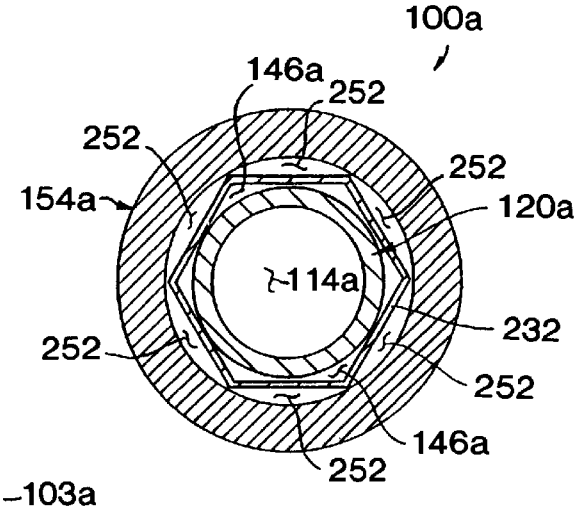
FIG. 6 is an enlarged scale cross-sectional view of the second proppant slurry screen apparatus, taken along line 6—6 of FIG. 5.

Illustrated in FIGS. 5 and 6 is another embodiment 100*a* of the proppant containment apparatus 100. For convenience, elements of the apparatus 100*a* representatively illustrated in FIGS. 5 and 6 which are substantially similar to those elements illustrated in the foregoing described figures have been given the same reference numerals, with the suffix "a" added thereto. FIG. 6 is a cross-sectional view of the apparatus 100*a*, taken laterally through ported housing 154*a*.

Note that in the apparatus 100*a* as shown in FIGS. 5 and 6, only the ported housing 154*a* and outer housing 150*a* portions of the apparatus 100*a* are representatively illustrated. The remainder of the apparatus 100*a* is the same as apparatus 100 shown in FIGS. 2A, 2B, 3, and 4. The apparatus 100*a* shown in FIGS. 5 and 6 differs in one respect from the apparatus 100 shown in FIGS. 2A and 2B in the method utilized to screen the proppant and debris from the fluid portion in circulation flow passage 146*a*.

In the representatively illustrated embodiment of the apparatus 100*a* in FIG. 5, a tubular screen 232 is disposed longitudinally in the circulation flow passage 146*a* between inner mandrel 120*a* and outer housing 150*a*. The screen 232 extends axially from a radially inwardly extending internal shoulder 234 formed on the ported housing 154*a*, through extension sub 152*a*, to a radially inwardly extending internal shoulder 236 formed on an extension sub 238. A large filtering surface area is thus possible utilizing screen 232 in apparatus 100*a*, to prevent clogging of the screen 232 with proppant and debris, and to provide less restriction to the fluid portion flow. Each of these benefits produce yet another benefit of reduced differential pressure across the screen 232, which reduces the possibility of failure of the screen. It is to be understood that more than one extension sub 152*a* may be used, permitting screen 232 to be extended axially as needed to achieve a desired screen surface area.

Screen 232 may be made of any suitable material capable of filtering proppant and debris from the fluid portion. Suitable materials for the screen 232 include sintered metal and wire-wrapped sand screen. The preferred material for the screen 232 representatively illustrated in FIG. 5 is wire-wrapped sand screen, but it is to be understood that other materials may be utilized without departing from the principles of the present invention.

Seals 240 and 242 are disposed in circumferential grooves 244 and 246, respectively, externally formed on the screen 232 upper portion 248 and lower portion 250, respectively. Seals 240 and 242 sealingly engage the ported housing 154*a* and extension sub 152*a*, respectively. Thus, any fluid flowing from the circulation flow passage 146*a* and through ports 208*a* to wellbore 102*a* must first pass through the screen 232. In this manner, the screen 232 prevents any proppant or debris in the fluid portion from entering the wellbore 102*a* above the packer 103*a*.

FIG. 6 shows the unique manner in which the axially extending screen 232 permits fluid communication from the circulation flow passage 146*a* to ports 208*a*. Screen 232 has a polygonal shape, representatively illustrated in FIG. 6 as having six sides, although other shapes may be utilized without departing from the principles of the present invention. Since lower portion 250 of the screen 232 is sealed to the extension sub 152*a*, the fluid portion flowing in the circulation flow passage 146*a* must pass between the screen 232 and inner mandrel 120*a*. Due to the shape of the screen 232, circulation flow passage 146*a* extends the entire length of the screen, enhancing the benefit described above of the large surface area of the screen.

The shape of the screen 232 also defines a flow passage 252 between the screen and outer housing 150*a*. The fluid portion flows in flow passage 252 after passing through screen 232. As with the circulation flow passage 146*a*, flow passage 252 extends the entire length of the screen 232. Thus, maximum utilization is afforded of the screen 232 surface area, due to the shape of the screen.

Referring now specifically to FIG. 5, another difference between apparatus 100*a* and apparatus 100 shown in FIG. 2A is the shape of the ports 208*a* in the ported housing 154*a*. Ports 208*a* are axially elongated slotted openings. Ports 208*a* thus maximize the tensile strength of the ported housing 154*a* as compared to ports 208 of apparatus 100, since ports 208*a* remove less cross-sectional area of the ported housing 154*a* for an equivalent port flow area. Alternatively, if it is not desired to increase the tensile strength of ported housing 154*a*, ports 208*a* may permit greater port flow area without decreasing the tensile strength of the ported housing 154*a*. Slotted ports 208*a* provide the additional benefit of exposing a greater length of the screen 232 to direct fluid communication with the wellbore 102*a*.

Figure 7:
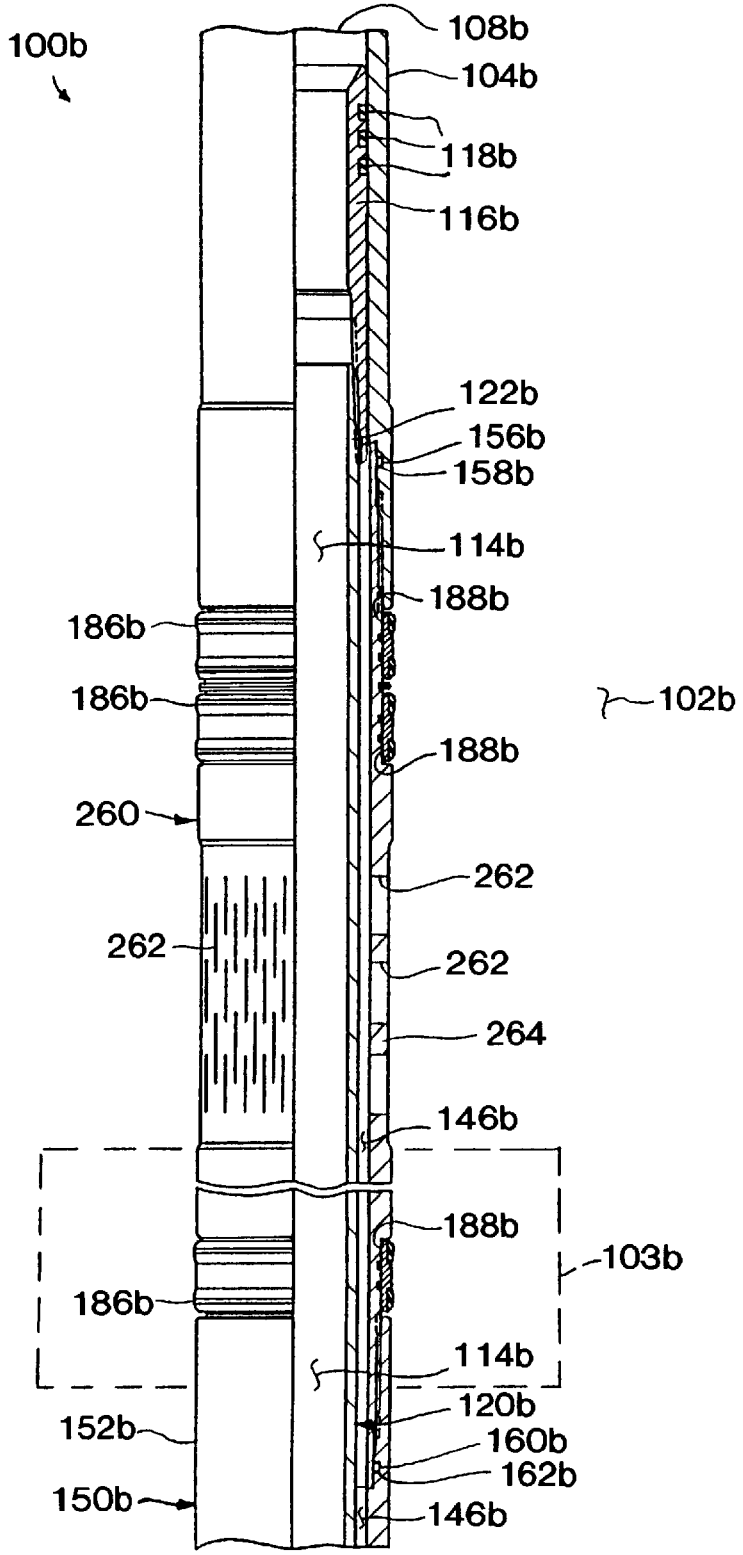
FIG. 7 is a quarter-sectional view of a third proppant slurry screen apparatus embodying principles of the present invention.

Illustrated in FIG. 7 is another embodiment 100*b* of the proppant containment apparatus 100. For convenience, elements of the apparatus 100*b* representatively illustrated in FIG. 7 which are substantially similar to those elements illustrated in the foregoing described figures have been given the same reference numerals, with the suffix "b" added thereto.

Note that in the apparatus 100*b* as shown in FIG. 7, only the portions of the apparatus 100*b* from upper connector 104*b* to extension sub 152*b* are representatively illustrated. The remainder of the apparatus 100*b* is the same as apparatus 100 shown in FIGS. 2A, 2B, 3, and 4. The apparatus 100*b* shown in FIG. 7 differs in one respect from the apparatus 100 shown in FIGS. 2A and 2B in the method utilized to screen the proppant and debris from the fluid portion in circulation flow passage 146*b*.

In the representatively illustrated embodiment of the apparatus 100*b* in FIG. 7, a separate screen is not utilized. Instead, a number of very narrow, longitudinally extending slots 262 are formed through sidewall 264 of ported housing 260. Slots 262 have sufficient width to permit flow therethrough of the fluid portion, but are narrow enough to prevent passage therethrough of most proppant and debris. Preferably, slots 262 each have a width of approximately 0.006–0.008 inch, but may also have widths of approximately 0.003–0.030 inch. Slots 262 may be formed on the sidewall 264 by any suitable method. Applicants' preferred method is to cut the slots 262 through the sidewall 264 with a laser, but it is to be understood that other methods may be utilized without departing from the principles of the present invention.

The slots 262 are circumferentially spaced apart and staggered to maximize the tensile strength of the ported housing 260. Slots 262 cumulatively have sufficient flow area to permit flow of the fluid portion through the sidewall 264. It is to be understood that other quantities, dimensions, and placements of the slots 262 may be utilized without departing from the principles of the present invention.

Many benefits are derived from use of the apparatus 100*b* having slots 262 formed on ported housing 260. There is no separate screen to install, seal, maintain, etc.; circulation flow passage 146*b* remains unobstructed within the ported housing 260; a large volume of the circulation flow passage 146*b* is thus available for accumulation of filtered proppant and debris; the ported housing 260 can withstand large differential pressures if necessary; and the apparatus 100*b*, having fewer components, is economical to manufacture, and easy to assemble and maintain.

The foregoing detailed description is to be clearly understood as being given by way of illustration and example only, the spirit and scope of the present invention being limited solely by the appended claims.

What is claimed is:

1. Proppant slurry delivery apparatus operatively positionable in a subterranean wellbore, the apparatus comprising:

a packer sealingly engageable with the wellbore, the packer having an axial internal bore extending from a first to a second side of said packer;

a tubular outer housing having an axial portion and inner and outer side surfaces, said outer housing extending from said packer first side to said packer second side, said outer housing outer side surface sealingly engaging said packer bore, and said axial portion extending axially outward from said packer first side, said axial portion having a radially extending port formed therethrough;

a tubular inner mandrel axially disposed within said outer housing, said inner mandrel having inner and outer side surfaces, said inner mandrel inner side surface defining an axial flow passage therein, and said inner mandrel outer side surface and said outer housing inner side surface defining a circulation flow passage therebetween, said circulation flow passage being in fluid communication with said outer housing port; and a screen disposed adjacent said outer housing port, said screen being capable of filtering fluid flowing from said circulation flow passage to the wellbore on said packer first side.

2. The apparatus according to claim 1, wherein said screen is integrally formed with said outer housing port.

3. The apparatus according to claim 2, wherein said screen comprises a plurality of slots formed through said outer housing axial portion, said slots having a width of approximately 0.003 inch to 0.030 inch.

4. The apparatus according to claim 1, wherein said screen is generally tubular and has first and second end portions; and further comprising first and second seals disposed on said outer housing inner side surface, said first and second seals axially straddling said outer housing port, and said first and second seals sealingly engaging said screen first and second end portions, respectively.

5. The apparatus according to claim 4, wherein said inner mandrel, said screen, and said outer housing axial portion are coaxially disposed in relation to each other, said screen being disposed radially intermediate said inner mandrel and said outer housing, and said screen further being disposed laterally opposite said outer housing port.

6. The apparatus according to claim 1, further comprising a tubular crossover attached to said outer housing, said crossover having an axial internal flow passage in fluid communication with said inner mandrel axial flow passage, an exit port formed radially through a sidewall portion thereof, and an axially extending circulation port formed through said sidewall portion, said exit port being in fluid communication with said crossover internal flow passage and the wellbore on said second side of said packer, and said circulation port being in fluid communication with said circulation flow passage.

7. The apparatus according to claim 1, wherein said outer housing further comprises a ported housing and an extension sub, said ported housing and said extension sub being sealingly attached to each other, said ported housing having a first internal sealing surface formed thereon and said extension sub having a second internal sealing surface formed thereon; and wherein said screen has first and second end portions, and first and second seals disposed on said first and second end portions, respectively, said first and second seals sealingly engaging said first and second sealing surfaces, respectively.

8. The apparatus according to claim 7, wherein said screen is generally tubular and has an axially extending polygon-shaped portion intermediate said screen first and second end portions.

9. The apparatus according to claim 8, wherein said screen polygon-shaped portion has inner and outer side surfaces, and wherein said circulation flow passage comprises first and second axial flow paths, said first axial flow path being disposed radially intermediate said inner mandrel outer side surface and said screen polygon-shaped portion inner side surface, and said second axial flow path being disposed radially intermediate said outer housing inner side surface and said screen polygon-shaped portion outer side surface.

10. Proppant slurry screen apparatus operatively positionable in a subterranean wellbore during flow thereinto of a slurry, the slurry including a fluid portion and a plurality of abrasive particles, the apparatus comprising:

a first tubular structure having first and second opposite ends, an exterior surface, and a first flow passage through which the slurry may be axially flowed from said first tubular structure first opposite end to said first tubular structure second opposite end, said first tubular structure being axially disposed within the wellbore;

a second tubular structure having first and second opposite ends, interior and exterior surfaces, an opening formed axially intermediate said second tubular structure first and second opposite ends and extending from said second tubular structure interior surface to said second tubular structure exterior surface, and first and second seal surfaces, said first and second seal surfaces being formed on said second tubular structure interior surface such that said opening is axially intermediate said first and second seal surfaces, said second tubular structure axially and exteriorly overlying said first tubular structure such that a second flow passage is formed radially intermediate said first tubular structure exterior surface and said second tubular structure interior surface;

a filter structure having first and second opposite end portions, and interior and exterior surfaces, said filter structure being capable of filtering the abrasive particles from the fluid portion in said second flow passage, said filter structure first and second opposite end portions having first and second seal surfaces formed respectively thereon; and first and second seal structures, said first seal structure sealingly engaging said first tubular structure first seal surface and said filter structure first seal surface, and said second seal structure sealingly engaging said first tubular structure second seal surface and said filter structure second seal surface.

11. The apparatus according to claim 10, wherein said filter structure is an axially extending tubular screen, said screen radially inwardly overlying said opening, such that slurry flowing in said second flow passage must pass through said screen intermediate said first and second seal structures prior to flowing through said opening.

12. The apparatus according to claim 11, wherein said screen is shaped such that an axially extending third flow passage is formed radially intermediate said screen and said second tubular structure interior surface.

13. The apparatus according to claim 10, further comprising a third tubular structure attached to said first and second tubular structures, said third tubular structure having third and fourth flow passages formed therethrough, said third flow passage being in fluid communication with said first flow passage and the wellbore, and said fourth flow passage being in fluid communication with said second flow passage and the wellbore, thereby permitting fluid communication between said first and second flow passages.

14. For use in a subterranean wellbore wherein a packer is set, the packer having an axial internal bore extending from a first to a second side of the packer, in conjunction with an abrasive slurry delivery structure having a crossover structure disposed in the wellbore on the second side of the packer with an internal flow passage through which an abrasive slurry containing abrasive particles may be axially flowed, a side wall outlet opening bounded by a peripheral side wall edge portion and outwardly through which abrasive slurry material from the internal flow passage may be discharged, and an internal circulation passage formed adjacent the peripheral side wall edge portion, a method of screening abrasive particles in the internal circulation passage after slurry erosion of the peripheral side wall edge portion, the method comprising the steps of:

providing a tubular outer housing having an axial portion and inner and outer side surfaces, said axial portion having a radially extending port formed therethrough;

inserting said outer housing into the packer such that said outer housing extends from the packer first side to the packer second side and said outer housing axial portion extends axially outward from the packer first side;

providing a tubular inner mandrel having inner and outer side surfaces, said inner side surface defining an axial flow passage therein, said inner mandrel axial flow passage being in fluid communication with the crossover structure internal flow passage;

disposing said inner mandrel axially within said outer housing such that said inner mandrel outer side surface and said outer housing inner side surface define a circulation flow passage therebetween and said circulation flow passage is in fluid communication with said outer housing port and the crossover structure internal circulation passage;

providing a screen capable of filtering the abrasive particles from the abrasive slurry; and disposing said screen such that fluid flowing from said circulation flow passage to said outer housing port must pass through said screen.

15. The method according to claim 14, wherein said step of providing said screen comprises the step of integrally forming said screen with said outer housing port.

16. The method according to claim 15, wherein said integrally forming step further comprises forming a plurality of slots through said outer housing axial portion, said slots having a width of approximately 0.006 inch to 0.008 inch.

17. The method according to claim 14, wherein said screen providing step comprises providing a generally tubular screen having first and second end portions; and further comprising the steps of providing first and second seals, and disposing said first and second seals on said outer housing inner side surface axially straddling said outer housing port and sealingly engaging said screen first and second end portions, respectively.

18. The method according to claim 17, wherein said inner mandrel disposing step comprises disposing said inner mandrel coaxially within said outer housing; and wherein said screen disposing step comprises disposing said screen coaxially within said outer housing, radially intermediate said inner mandrel and said outer housing, and laterally opposite said outer housing port.

19. The method according to claim 14, wherein said outer housing providing step further comprises the steps of providing a ported housing and an extension sub, forming a first internal sealing surface on said ported housing, forming a second internal sealing surface on said extension sub, sealingly attaching said ported housing to said extension sub; wherein said screen providing step further comprises providing said screen having first and second end portions, and first and second seals disposed on said first and second end portions, respectively; and wherein said screen disposing step further comprises disposing said screen within said ported housing and said extension sub such that said first and second seals sealingly engage said first and second sealing surfaces, respectively.

20. The method according to claim 14, wherein said screen providing step comprises providing said screen having an axially extending polygon-shaped portion.

21. The method according to claim 20, wherein said screen providing step further comprises providing said screen polygon-shaped portion having inner and outer side surfaces; and wherein said screen disposing step further comprises dividing said circulation flow passage into first and second axial flow paths, said first flow path being intermediate said outer housing inner side surface and said screen polygon-shaped portion outer side surface and said second flow path being intermediate said inner mandrel outer side surface and said screen polygon-shaped portion inner side surface.

22. A method of screening proppant delivered to a subterranean wellbore in a pressurized slurry, the method comprising the steps of:

providing a first tubular structure having first and second opposite ends, an exterior surface, and a first flow passage through which the slurry may be axially flowed from said first tubular structure first opposite end to said first tubular structure second opposite end;

disposing said first tubular structure axially within the wellbore;

providing a second tubular structure having first and second opposite ends, interior and exterior surfaces, an opening formed axially intermediate said second tubular structure first and second opposite ends and extending from said second tubular structure interior surface to said second tubular structure exterior surface;

forming first and second seal surfaces on said second tubular structure interior surface such that said opening is axially intermediate said first and second seal surfaces;

disposing said second tubular structure axially and exteriorly overlying said first tubular structure;

forming a second flow passage radially intermediate said first tubular structure exterior surface and said second tubular structure interior surface;

providing a filter structure having first and second opposite end portions, and interior and exterior surfaces, said filter structure being capable of filtering the proppant from the slurry in said second flow passage;

forming first and second seal surfaces on said filter structure first and second opposite end portions, respectively;

providing first and second seal structures;

sealingly engaging said first tubular structure first seal surface and said filter structure first seal surface with said first seal structure; and sealingly engaging said first tubular structure second seal surface and said filter structure second seal surface with said second seal structure.

23. The method according to claim 22, wherein said filter structure providing step comprises providing an axially extending tubular screen; and wherein said filter structure disposing step comprises disposing said screen radially inwardly overlying said opening, such that slurry flowing in said second flow passage must pass through said screen intermediate said first and second seal structures prior to flowing through said opening.

24. The method according to claim 22, further comprising the step of forming an axially extending third flow passage radially intermediate said screen and said second tubular structure interior surface.

25. The method according to claim 22, further comprising the steps of:

providing a third tubular structure, said third tubular structure having third and fourth flow passages formed therethrough, said third flow passage being in fluid communication with said first flow passage and the wellbore, and said fourth flow passage being in fluid communication with said second flow passage and the wellbore; and attaching said third tubular structure to said first and second tubular structures, thereby permitting fluid communication between said first and second flow passages.

26. Proppant slurry delivery apparatus operatively positionable in a subterranean wellbore, the apparatus comprising:

a housing;

a slurry delivery flow passage extending generally longitudinally in the housing;

a return circulation flow passage extending generally longitudinally in the housing and in fluid communication with an exterior of the housing; and a screen filtering fluid flow between the return circulation flow passage and the exterior of the housing.

27. Proppant slurry delivery apparatus operatively positionable in a subterranean wellbore, the apparatus comprising:

a generally tubular housing assembly; and a packer sealingly engaged with the housing assembly and settable in the wellbore to divide the wellbore into first and second annular portions, the housing assembly including a slurry delivery flow passage extending generally longitudinally therein and in fluid communication with the first annular wellbore portion, a return circulation flow passage extending generally longitudinally in the housing assembly and in fluid communication with the second annular wellbore portion, and a screen filtering fluid flow between the return circulation flow passage and the second annular wellbore portion.

* * * * *